US005423097A

United States Patent [19]

Brulé et al.

[11] Patent Number: 5,423,097

[45] Date of Patent: Jun. 13, 1995

[54] EMERGENCY DROP FOWLER AND GATCH

[75] Inventors: Phillippe Y. Brulé, Richland; Richard J. Bartow, Athens Township, Calhoun County, both of Mich.

[73] Assignee: Stryker Corporation, Kalamazoo, Mich.

[21] Appl. No.: 86,544

[22] Filed: Jul. 1, 1993

[51] Int. Cl.[6] ..... A61G 7/00

[52] U.S. Cl. ..... 5/617; 5/618; 403/324; 403/378

[58] Field of Search ..... 5/613, 617, 618; 403/324, 378, 321, 109

[56] References Cited

U.S. PATENT DOCUMENTS

| | | | |
|---|---|---|---|
| 3,039,119 | 6/1962 | Bourgraf et al. | 5/617 |
| 4,038,709 | 8/1977 | Kerwit . | |
| 4,222,131 | 9/1980 | Holdt et al. . | |
| 4,346,487 | 8/1982 | Holdt et al. . | |
| 4,559,655 | 12/1985 | Peck . | |
| 5,193,419 | 3/1993 | Lee | 403/324 X |
| 5,329,657 | 7/1994 | Bartley et al. | 5/617 |

FOREIGN PATENT DOCUMENTS

| | | | |
|---|---|---|---|
| 2146241 | 4/1985 | United Kingdom | 5/617 |

OTHER PUBLICATIONS

Sketch "A", filed by applicant on Jul. 1, 1993.

*Primary Examiner*—Michael F. Trettel

*Attorney, Agent, or Firm*—Flynn, Thiel, Boutell & Tanis

[57] ABSTRACT

A bed has movable upper body and knee support sections, and first and second coupling arrangements which each couple a respective drive arrangement to one of the upper body and knee support sections to effect movement thereof between inclined and horizontal positions. Each coupling arrangement includes two telescoping tubes and a locking mechanism for releasably holding the tubes against relative movement, the locking mechanisms of both coupling arrangements being released in response to manual operation of a release handle. Each locking mechanism includes a transverse cylindrical locking element rotatably supported on a first of the tubes for movement between a locking position in which a portion thereof engages a semicylindrical recess in the second tube, and a release position in which the tubes are free to move relative to each other with a portion of the second tube which extends lengthwise thereof sliding within a transverse recess in the locking element.

18 Claims, 10 Drawing Sheets

EMERGENCY DROP FOWLER AND GATCH

FIELD OF THE INVENTION

This invention relates to a hospital bed having an upper body support section which can be pivoted in response to operation of a drive mechanism and, more particularly, to such a bed which also has a releasable coupling arrangement that can disengage the upper support section from the drive arrangement so that the upper body support section can move rapidly from an inclined position to a horizontal position.

BACKGROUND OF THE INVENTION

Hospital beds and stretchers typically have an upper body support section which can be pivoted by a drive mechanism from a horizontal position to an inclined position in order to raise the patient to a partially sitting position or a substantially fully sitting position. Often, these beds also have a knee support section which can be pivoted between horizontal and inclined positions so that, when the patient is raised to the sitting position, the patient does not tend to slide toward the foot of the bed.

When an emergency occurs while the patient is in the sitting position, for example where the patient experiences heart failure, it is important that the patient be moved as rapidly as possible back to the horizontal position so that appropriate therapy such as CPR (cardiopulmonary resuscitation) can be administered. The manual or motor-driven mechanism typically utilized to raise and lower the upper body support section or knee support section tends to move the section far too slow to be satisfactory for use in an emergency situation. Therefore, emergency releases have previously been developed to permit the upper body support section to be quickly disengaged from the drive mechanism for rapid movement to the horizontal position.

While the prior arrangements have been generally adequate for their intended purposes, they have not been satisfactory in all respects. For example, some are relatively complex and expensive, whereas others use hydraulic fluid which may be subject to leakage and the attendant risk of slippery spots on hospital floors.

Accordingly, it is an object of the present invention to provide an improved arrangement for rapidly disengaging an upper body support section of a bed from its drive arrangement.

A further object of the invention is to provide such an arrangement which is entirely mechanical, and is of relatively simple and inexpensive construction.

A further object is to provide such an arrangement which is reliable and has a relatively long operational lifetime, and requires little or no maintenance.

A further object is to provide such an arrangement in which a single manually operable release handle can release both the upper body support section and the knee support section, and in which the manual release can be easily and conveniently effected from either side of the bed.

SUMMARY OF THE INVENTION

The objects and purposes of the invention, including those set forth above, are met according to one form of the invention by providing a bed which includes: an upper body support section supported for movement between a substantially horizontal position and a raised position; a selectively actuatable drive mechanism; a coupling arrangement for releasably drivingly coupling the drive mechanism to the upper body support section to effect movement of the upper body support section in response to operation of the drive mechanism, the coupling arrangement including an elongate tubular first member and an elongate second member which has a portion telescopically slidably supported within the first member for movement between first and second positions relative thereto, wherein as the upper body support section is moved toward its raised position by the drive mechanism and the coupling arrangement, the second member is urged toward the second position with respect to the first member, the coupling arrangement further including a locking portion provided on one of the first and second members and a locking part supported on the other thereof for movement between a locking position in which the locking part physically engages the locking portion when the first and second parts are in their first position and a release position in which the locking part is free of engagement with the locking portion, wherein when the locking part is engaging the locking portion the second member is held against movement away from the first position toward the second position with respect to the first member; and a manually operable release arrangement for effecting movement of the locking part to its release position, so that the upper body support section is disengaged from the drive mechanism to permit rapid movement of the upper body support section to its substantially horizontal position.

According to a different form of the invention, a bed includes: an upper body support section supported for movement between a substantially horizontal position and a raised position; a selectively actuatable drive mechanism; a coupling arrangement for releasably drivingly coupling the drive mechanism to the upper body support section to effect movement of the upper body support section in response to operation of the drive mechanism, a cable having a first end operationally coupled to the coupling arrangement, the cable having an outer sleeve and a wire slidably movable within the outer sleeve, the coupling arrangement being responsive to movement of the wire in a release direction within the outer sleeve for disengaging the upper body support section from the drive mechanism to permit rapid movement of the upper body support section to its substantially horizontal position; and a manually controlled cable operating arrangement for effecting movement of the wire in the release direction within the sleeve of the cable, including a manually operable release handle supported for pivotal movement about an axis, a cable operating arm supported for movement about the axis independently of the release handle and operationally coupled to the wire of the cable at a location spaced radially from the axis, and a further arm nonrotatably coupled to the release handle for pivotal movement therewith and having a portion which is spaced from the pivot axis and is engageable with the cable operating arm for pivoting the cable operating arm in a direction pulling the wire of the cable in the release direction in response to manual rotation of the release handle.

Yet another form of the invention relates to a bed which includes: an upper body support section supported for movement between a substantially horizontal position and a raised position; a selectively actuatable drive mechanism; a coupling arrangement for releasably drivingly coupling the drive mechanism to the upper body support section to effect movement of the upper body support section in response to operation of the drive mechanism, the coupling arrangement including first and second members supported for relative movement with respect to each other between first and second positions, wherein as the upper body support section is moved toward its raised position by the drive mechanism and the coupling arrangement with the first and second members in their first position the first and second members are urged to move toward their second position, the coupling arrangement further including a locking part supported on the first member for rotation about an axis extending traversely to a direction of movement of the second member relative to the locking part, the locking part including a portion with a radially outwardly facing first arcuate surface of predetermined radius which is concentric with respect to the axis, the second member having a locking recess with a radially inwardly facing second arcuate surface which has substantially the predetermined radius and is substantially concentric to the axis when the first and second members are in their first position, the locking part being rotatable about the axis between a locking position and a release position, wherein when the first and second members are in their first position and the locking part is in its locking position the portion of the locking part is disposed in the recess in the second member so that the first and second arcuate surfaces are adjacent and engagement thereof prevents relative movement of the first and second members away from their first position toward their second position, and wherein when the locking part is in its release position the portion thereof is free of engagement with the recess and the first and second members are free to move relative to each other; and a manually operable release arrangement for pivoting the locking part to its release position so that the upper body support section is disengaged from the drive mechanism to permit rapid movement of the upper body support section to its substantially horizontal position.

The invention also encompasses a bed which includes: an upper body support section supported for movement between a substantially horizontal position and a raised position; a selectively actuatable drive mechanism; a coupling arrangement for releasably drivingly coupling the drive mechanism to the upper body support section to effect movement of the upper body support section in response to operation of the drive mechanism, the coupling arrangement including first and second members supported for relative movement with respect to each other between first and second positions, wherein as the upper body support section is moved toward its raised position by the drive mechanism and the coupling arrangement with the first and second members in their first position the first and second members are urged to move toward their second position, the coupling arrangement further including in the first member an opening with a substantially cylindrical inner surface of predetermined radius which is concentric to an axis extending traversely to a direction of movement of the second member with respect to the inner surface, a locking part which is a substantially cylindrical element having a cylindrical outer surface with substantially the predetermined radius, the locking part having a portion rotatably disposed in the opening in the first member for movement between a locking position and a release position, the locking part having a further portion with a recess axially aligned with the second member, the second member having therein a locking recess, wherein when the first and second members are in their first position and the locking part is in its locking position the further portion of the locking part is disposed in the locking recess in the second member and engagement therebetween prevents relative movement of the first and second members away from their first position toward their second position, and wherein when the locking part is in its release position the recess in the locking part is aligned with the second member and a portion of the second member which extends along the second member in the direction of movement thereof is movable within the recess in the locking part as the first and second members move between their first and second positions; and a manually operable release arrangement for pivoting the locking part to its release position so that the upper body support section is disengaged from the drive mechanism to permit rapid movement of the upper body support section to its substantially horizontal position.

A further form of the invention involves a bed which includes: an upper body support section supported for movement between a substantially horizontal position and a raised position; a selectively actuatable drive mechanism; a coupling arrangement for releasably drivingly coupling the drive mechanism to the upper body support section to effect movement of the upper body support section in response to operation of the drive mechanism; an elongate release member extending traversely of the bed and supported for rotation about a transverse axis between a locking position and a release position, the release member having spaced handle portions at respective ends thereof which are each disposed adjacent a respective side of the bed; and an arrangement responsive to rotation of the release member to its release position for releasing the coupling arrangement so that the upper body support section is disengaged from the drive mechanism to permit rapid movement of the upper body support section to the substantially horizontal position.

Yet a different form of the invention relates to a bed which includes: an upper body support section supported for movement between a substantially horizontal position and a raised position, and a knee support section supported for movement between a substantially horizontal position and a raised position; a selectively actuatable first drive mechanism; a first coupling arrangement for releasably drivingly coupling the first drive mechanism to the upper body support section for effecting movement of the upper body support section in response to operation of the first drive mechanism; a selectively actuatable second drive mechanism; a second coupling arrangement for releasably drivingly coupling the second drive mechanism to the knee support section for effecting movement of the knee support section in response to operation of the second drive mechanism; a manually operable release member supported for movement between normal and release positions; and an arrangement responsive to movement of the release member to its release position for releasing each of the first and second coupling arrangements so that the upper body support section and the knee support section are respectively disengaged from the first drive mechanism and the second drive mechanism to permit rapid movement of the upper body support section and the knee support section to their substantially horizontal positions.

BRIEF DESCRIPTION OF THE DRAWINGS

Two preferred embodiments of the present invention are described in detail below with reference to the accompanying drawings, in which.

DETAILED DESCRIPTION

FIGS. 1 through 7 show a first embodiment of a bed or stretcher 10 which embodies the present invention. The stretcher 10 has a conventional wheeled base which is not illustrated in FIG. 1 for purposes of clarity, has a patient support section 11, and has two vertically adjustable lifts 12 and 13 extending between the base and the patient support section 11.

Figure 1:
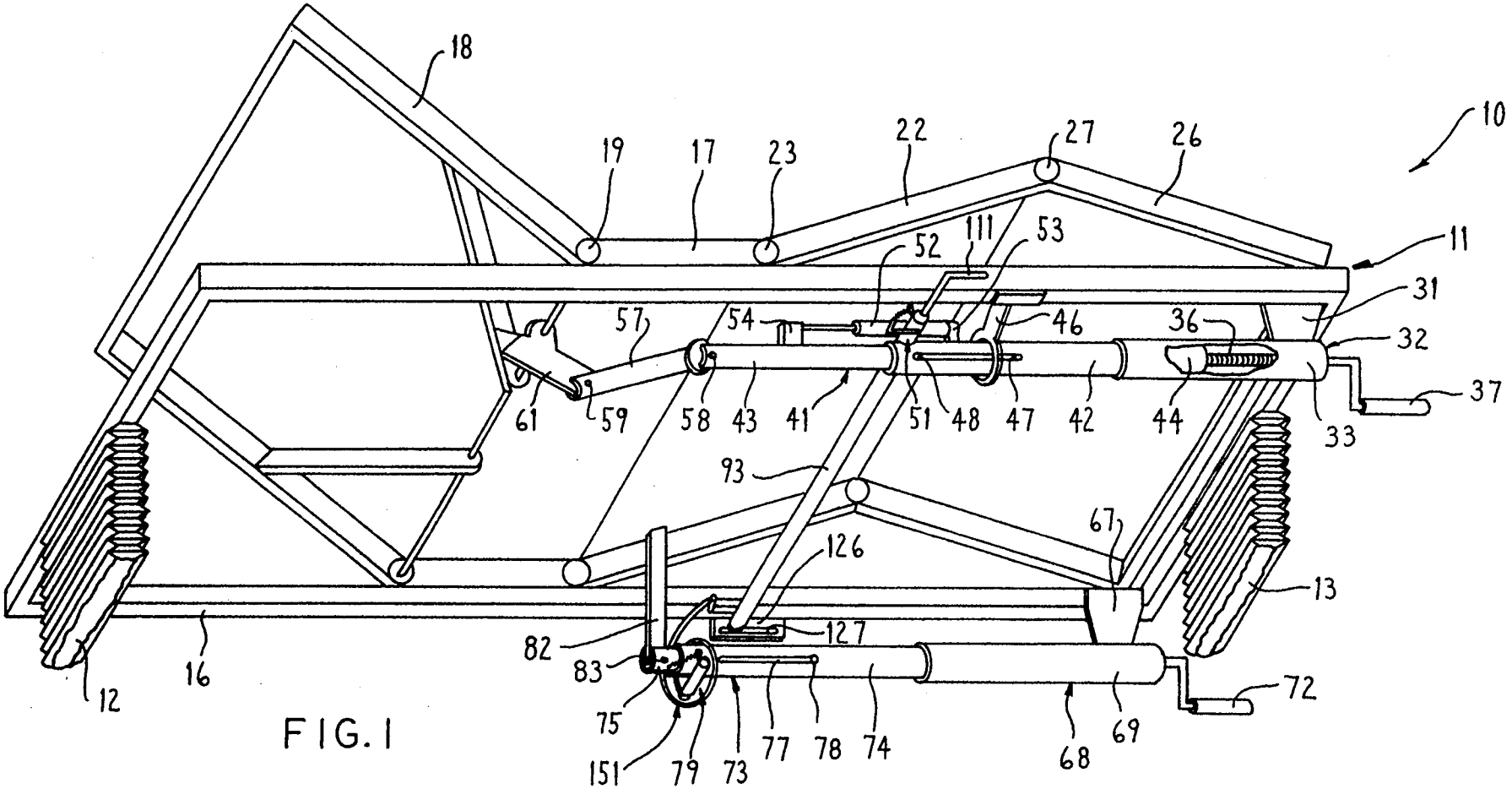
FIG. 1 is a diagrammatic perspective view of the underside of part of a hospital stretcher which embodies the present invention.

The lifts 12 and 13 are conventional, and each lift includes a vertically extending hydraulic cylinder having its ends respectively secured on the base and the patient support section 11, and includes a bellows-like shroud which is provided around the hydraulic cylinder and which is visible in FIG. 1. The lifts 12 and 13 are conventional and not in and of themselves a part of the present invention, and are therefore not illustrated and described in further detail.

The patient support section 11 includes a rectangular frame 16 having its ends supported at the upper ends of lifts 12 and 13. A seat section 17 extends traversely across and has its opposite ends secured to the sides of the frame 16, and an upper body support section 16 has an edge supported at one edge of the seat section 17 for pivotal movement about a traversely extending horizontal axis 19. The upper body support section 18 is movable between a raised position shown in FIG. 1 in which it is inclined with respect to the frame 16, and a horizontal position in which it is adjacent and rests on the frame 16. On the opposite side of the seat section 17, a knee support section 22 has an edge supported on an edge of the seat section 17 opposite from the upper body support section 18 for pivotal movement between horizontal and raised positions about a further traversely extending horizontal pivot axis 23, and the opposite edge of the knee support section 22 supports a foot support section 26 for pivotal movement about a horizontal pivot axis 27. The free end of the foot support section 26 sidably engages the top of the frame 16. The upper body support section 18 is commonly called a fowler, and the knee and foot support sections 22 and 26 are together commonly called a gatch.

A bracket 31 is fixedly secured to the frame 16, and supports a conventional drive mechanism 32 which includes a tubular sleeve 33, a threaded shaft 36 rotatably concentrically supported within the sleeve 33 and held against axial movement, and a hand crank 37 which can be used to rotate the threaded shaft 36. The drive mechanism 32 is conventional and not in and of itself the focus of the present invention, and is therefore not described in further detail. The drive mechanism 32 could be replaced with other conventional drive mechanisms, such as a known drive mechanism which also includes a selectively actuatable electric motor so that the shaft 36 can be rotated automatically by the motor or manually by the crank 37.

A coupling arrangement 41 includes a cylindrical tubular outer member 42 and a cylindrical tubular inner member 43, the outer member 42 having an outside diameter slightly smaller than the inside diameter of the sleeve 33 and having an end 44 which is telescopically slidably disposed within the sleeve 33, and the inner member 43 having an outside diameter slightly smaller than the inside diameter of the outer member 42 and having an end which is telescopically slidably disposed within the outer member 42. The end 44 of the member 42 has internal threads which engage the threaded shaft 36, so that the tube 42 moves leftwardly and rightwardly in FIG. 1 in response to rotation of the crank 37 and shaft 36 in respective directions.

A further bracket 46 is secured to the frame and has a circular opening through which the outer member 42 slidably extends, in order to support the outer member 42 and coupling arrangement 41 for lengthwise movement. The outer member 42 has an axially extending slot 47 near one end, and a pin 48 on the inner member 43 is slidably disposed within the slot 47 in order to limit the movement of the inner member 43 relative to the outer member 42.

A releasable locking mechanism 51 is provided on the outer member 42, and releasably holds the members 42 and 43 in the relative position shown in FIG. 1, where the member 43 is in its extended position. When the locking mechanism 51 is released, the inner member 43 can move in a direction telescopically into the outer member 42 so that the overall length of the coupling arrangement 41 decreases. The locking mechanism 51 is described in more detail later.

A gas cylinder 52 has its ends respectively supported on blocks 53 and 54, which in turn are respectively secured to the outer member 42 and the inner member 43. The gas cylinder 52 limits the speed with which the members 42 and 43 can move relative to each other when the locking mechanism 51 is released.

A link member 57 has one end pivotally coupled at 58 to an outer end of the inner member 43, and has its opposite end pivotally coupled at 59 to an arm 61 which is fixedly secured to the upper body support section 18. When the crank 37 is manually turned while the locking mechanism 51 is engaged, the coupling arrangement 41 which includes the members 42 and 43 will move leftwardly or rightwardly in FIG. 1 while maintaining a fixed length, thereby pivoting the upper body support section 18 upwardly or downwardly through the link member 57 and the arm 61. When the upper body support section 18 is in the raised or inclined position shown in FIG. 1, and when the locking mechanism 51 is released in a manner described in more detail later, the inner member 43 becomes free to move rightwardly into the stationary outer member 42, at a speed limited by the gas cylinder 52, thereby permitting the upper body support section 18 to pivot relatively rapidly from the inclined position of FIG. 1 to a horizontal position.

On the opposite side of the bed is a further bracket 67 supporting a further drive mechanism 68 which is identical to the drive mechanism 32, the drive mechanism 68 having a sleeve 69 and crank 72. A further coupling arrangement 73, which is similar to the coupling arrangement 41, includes a tubular outer member 74 and tubular inner member 75, the outer member 74 having a slot 77 which slidably receives a pin 78 on the inner member 75. A releasable locking mechanism 79 is provided on the outer member 74 and can releasably hold the inner member 75 against movement relative to the outer member 74. An arm 82 is fixedly secured to the knee support section 22, and has its outer end pivotally coupled at 83 to an outer end of the inner member 75.

When the crank 72 is rotated, the coupling arrangement 73 which includes members 74 and 75 moves leftwardly or rightwardly with a fixed length, causing the knee support section to pivot about axis 23 with respect to the seat section 17. When the knee support section 22 is in the raised position shown in FIG. 1, and when the locking mechanism 79 is released in a manner described in more detail later, the inner member 75 becomes free to move leftwardly relative to the outer member 74, thereby permitting the knee support section 22 to relatively rapidly pivot downwardly to its horizontal position adjacent the frame 16.

It should be noted that there are some differences between the coupling arrangement 41 and the coupling arrangement 73. In particular, the coupling arrangement 73 does not include a gas cylinder similar to that shown at 52 for the coupling arrangement 41, and does not have a bracket similar to that shown at 46 for the coupling arrangement 41. Further, the coupling arrangement 41 is normally in an extended configuration and collapses in length when the locking mechanism 51 is released, whereas the coupling arrangement 73 is normally maintained in a telescopically collapsed condition and increases in length when the locking mechanism 79 is released.

Figure 2:
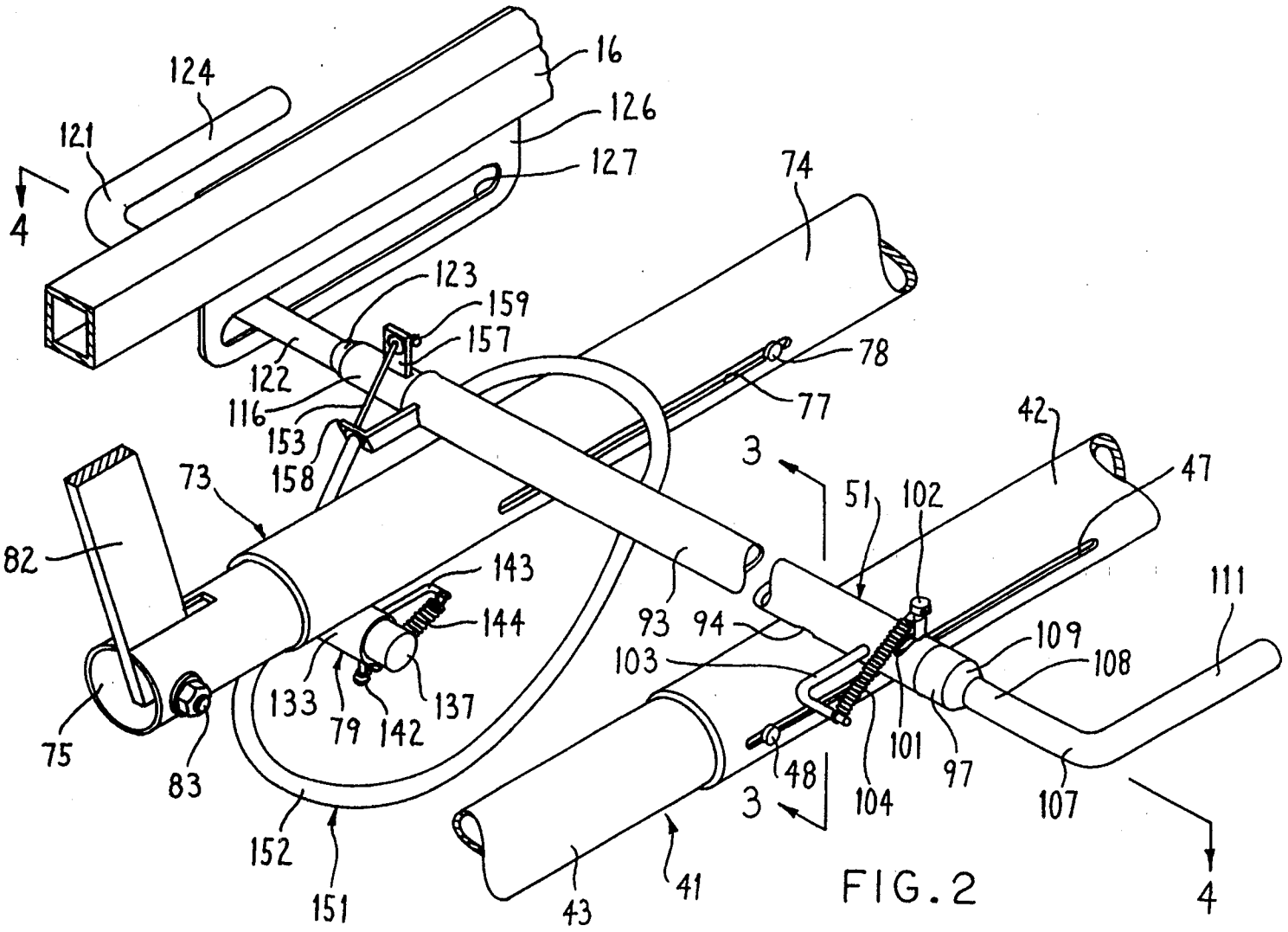
FIG. 2 is a fragmentary perspective view in an enlarged scale of part of the stretcher of FIG. 1.
Figure 3:
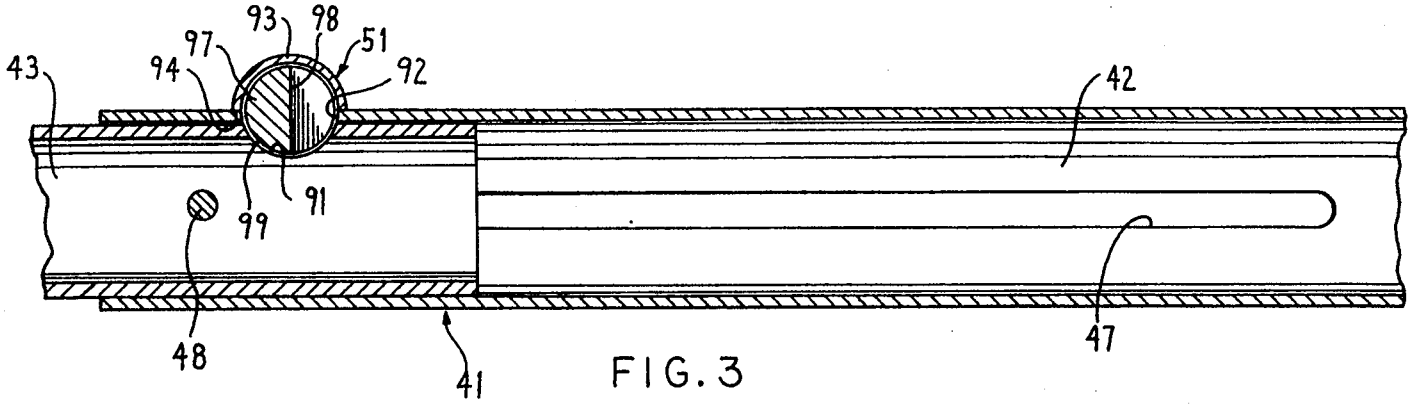
FIG. 3 is a sectional view taken along the line 3—3 in FIG. 2.

The releasable locking mechanism 51 will now be described in more detail. With reference to FIG. 3, the tubular inner member 43 has a traversely extending recess 91 of semicircular cross section in its upper side near one end, and the outer member 42 has a traversely extending recess 92 of semicircular cross section in its upper side near one end. The recesses 91 and 92 have the same radius, and are coaxially aligned when the tubes 42 and 43 are in the position (FIG. 1) in which the releasable locking mechanism 51 can be engaged. Referring to FIGS. 2 and 3, an elongate tube 93 which extends transversely of the bed has near one end in its underside a traversely extending recess 94 of semicircular cross section, the recess 94 having a radius equal to the outside radius of the outer member 42, and the outer member 42 having a portion disposed within the recess 94. The inside radius of the central opening through tube 93 is equal to the radius of recesses 91 and 92, and the tube 93 is welded to the outer member 42 so that the central opening is coaxial with the recess 92 in the member 42.

Figure 4:
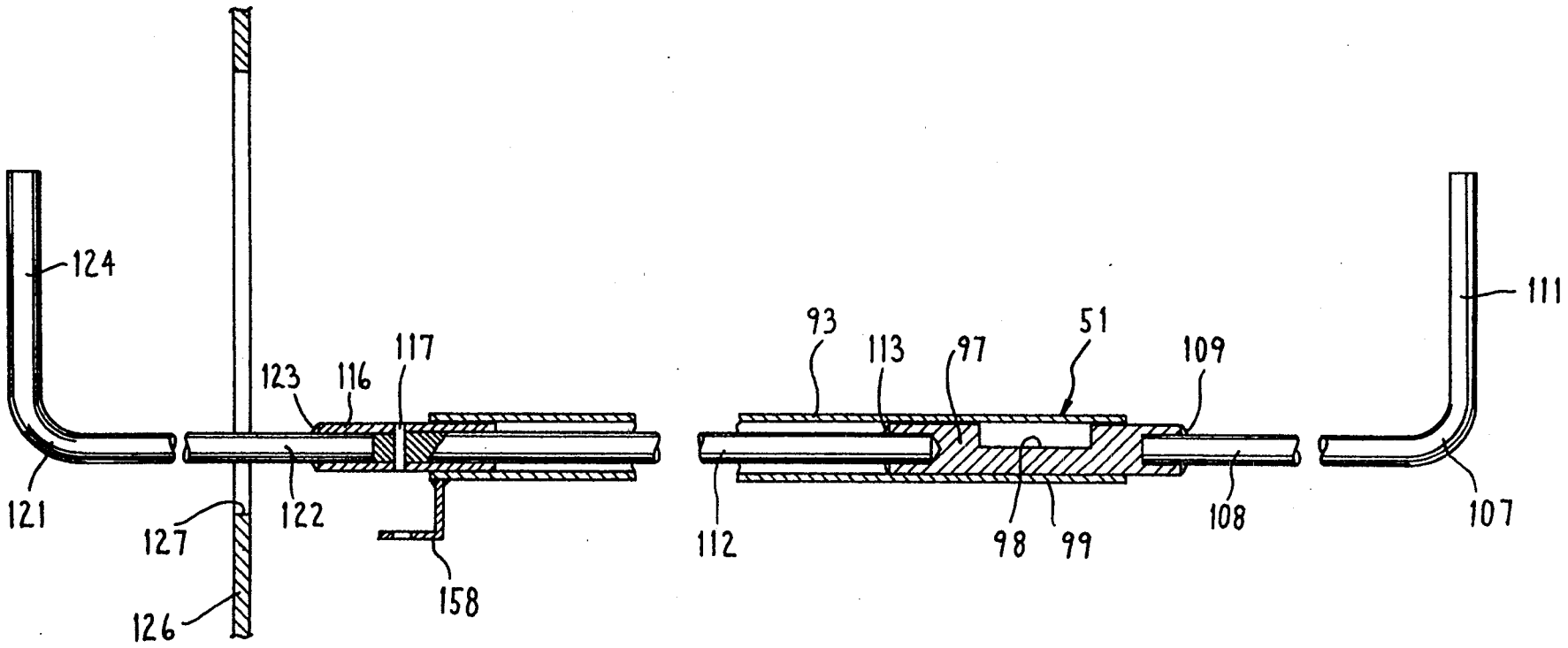
FIG. 4 is a sectional view taken along the line 4—4 in FIG. 2.

As shown in FIGS. 2–4, a cylindrical locking element 97 has a radius slightly less than the radius of the central opening through tube 93, and is rotatably disposed within the tube 93 at a location axially aligned with the members 42 and 43. The locking element 97 has a traversely extending rectangular recess 98 which is axially aligned with the members 42 and 43, and has on a side thereof opposite from the recess 98 an arcuate surface 99 which is a part of the cylindrical outer surface of the locking element.

The locking element 97 can be rotated to a locking position shown in FIG. 3 and 4, in which a portion thereof is disposed within the recesses 91 and 92 so that the arcuate surface 99 engages the arcuate surface of recess 91 and prevents the inner member 43 from moving rightwardly in FIG. 3 with respect to the outer member 42. The locking element 97 can be pivoted 90° clockwise from the locking position of FIG. 3 to a release position, in which the recess 98 opens downwardly and the inner member 43 can slide lengthwise within the recess 98 in a rightward direction in FIG. 3.

As best seen in FIG. 2, the tube 93 has an arcuate slot 101 which extends circumferentially through an angle of slightly more than 90°, and the locking element 97 has secured in it a pin 102 which extends radially outwardly through the arcuate slot 101, engagement of pin 102 with the ends of slot 101 limiting rotational movement of the locking element 97. An L-shaped spring support has one end welded to the tube 93 and has its opposite end supporting one end of a helical expansion spring 104, the opposite end of spring 104 being supported on the radially outer end of pin 102. The expansion spring 104 resiliently urges the locking element 97 to rotate toward the locking position shown in FIGS. 3 and 4.

Referring to FIG. 4, an L-shaped rod 107 has a first leg 108 which is coaxial with the axis of rotation of the locking part 97 and which has its outer end disposed in an axial bore in one end of the locking part 97 and secured thereto by welding at 109. The other leg 111 of the member 107 extends approximately horizontally, and serves as a manually operable release member, as described later.

A sleeve 116 has an outside radius slightly less than the inside radius of the central opening through tube 93, has one end rotatably disposed within the end of tube 93 remote from locking element 97, and has its other end projecting outwardly beyond that end of tube 93. A cylindrical rod 112 with a radius smaller than the inside radius of tube 93 is disposed concentrically within the tube 93, has one end disposed within an axial bore in the locking element 97 and secured against rotational or axial movement with respect to the element 97 by welding at 113, and has its opposite end disposed in the sleeve 116 and secured against rotational or axial movement with respect to the sleeve 116 by a radially extending pin 117.

A further L-shaped member 121 has a leg 122 which is coaxial to the axis of rotation of locking element 97 and which has its outer end disposed within sleeve 116 and secured by welding 123, and has a further leg 124 which extends approximately horizontally and serves as another manually operable release member, as described later. Referring to FIGS. 2 and 4, a plate 126 is secured to and extends vertically downwardly from the frame 16, and has a horizontally extending slot 127 through which the leg 122 of L-shaped member 121 extends. As the drive mechanism 32 (FIG. 1) moves the outer member 42 rightwardly and leftwardly in FIG. 1, the tube 93 secured to member 42 moves with it, and causes the leg 122 to slide within the slot 127 in plate 126.

Figure 6:
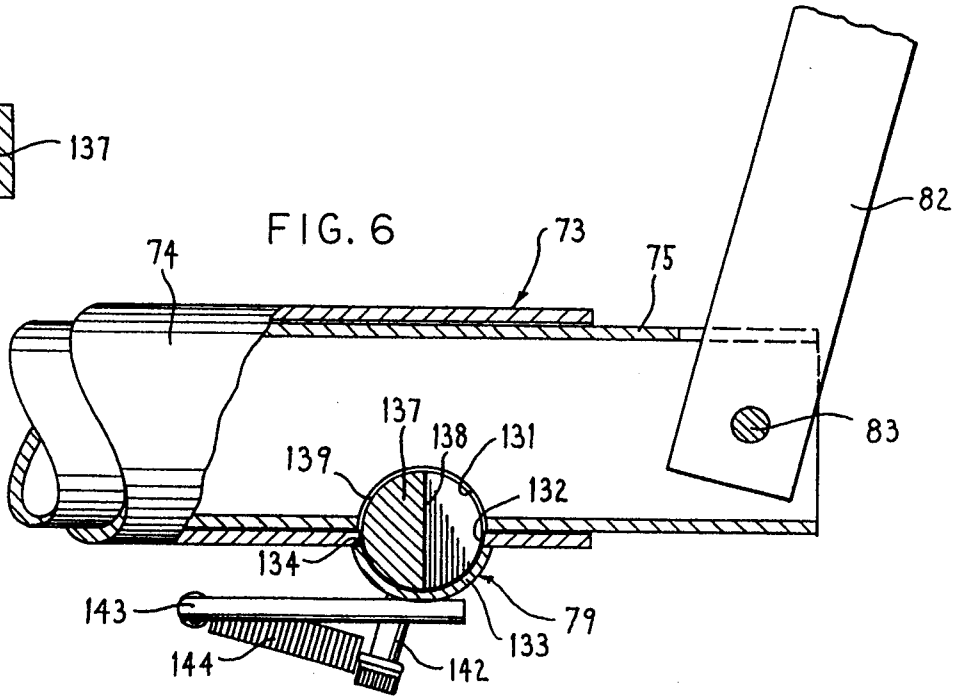
FIG. 6 is a sectional view taken along the line 6—6 in FIG. 5.
Figure 7:
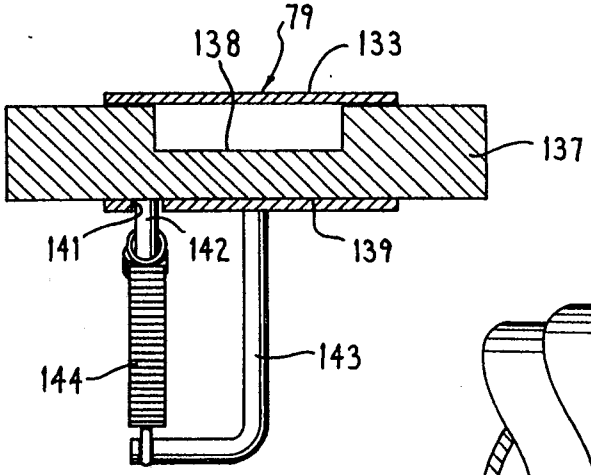
FIG. 7 is a sectional view taken along the line 7—7 in FIG. 5.
Figure 5:
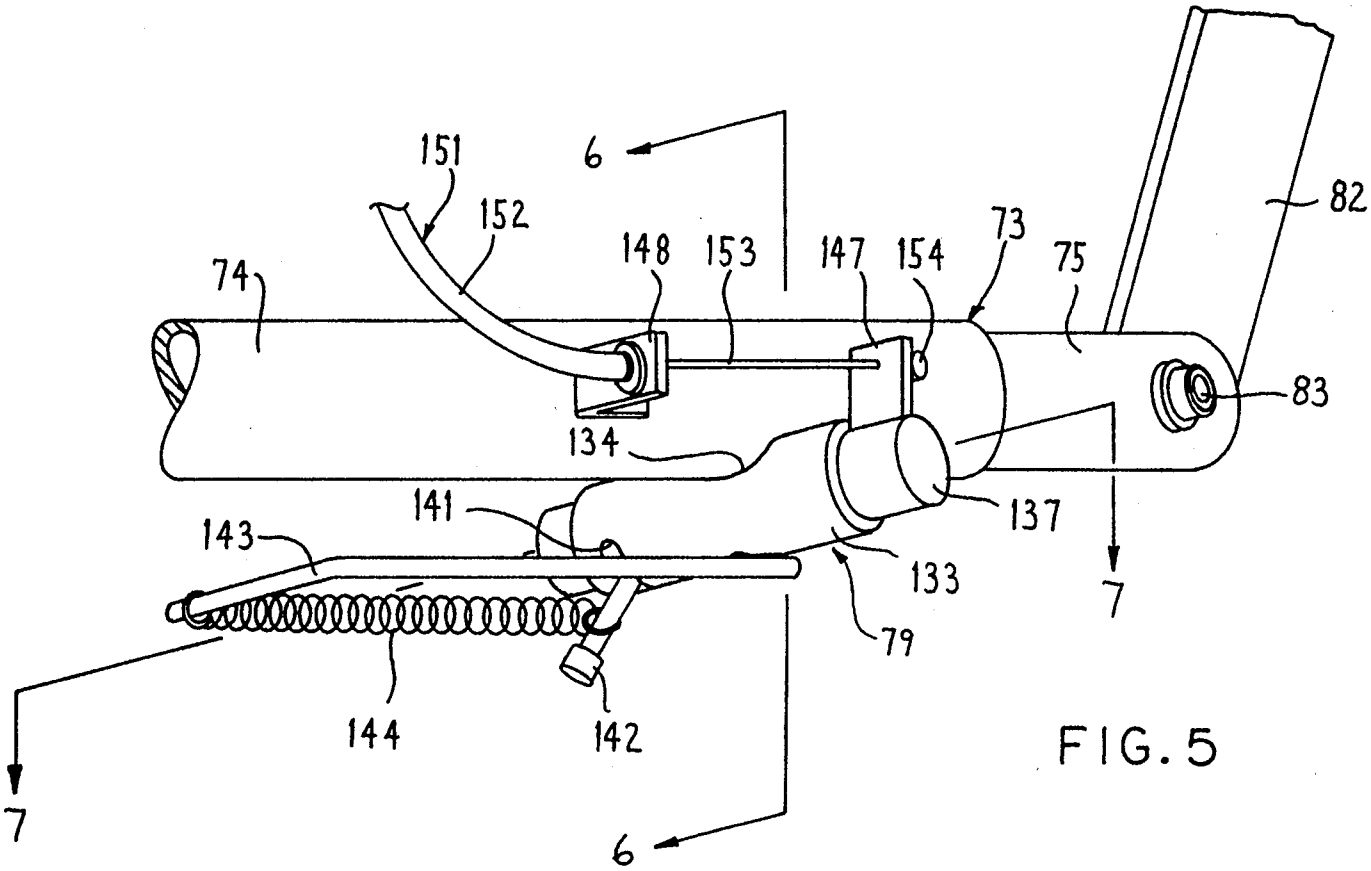
FIG. 5 is a fragmentary perspective view in art enlarged scale of another portion of the stretcher shown in FIG. 1.

Referring to FIGS. 5–7, the releasable locking mechanism 79 is similar to the locking mechanism 51, and in particular includes a traverse semicylindrical recess 131 in the inner member 75, a traverse semicylindrical recess 132 in the outer member 74, a traversely extending tube 133 which is welded to the member 74 so that the member 74 is received in a traverse semicylindrical recess 134 in the tube 133. A cylindrical locking element 137 is rotatably disposed within the tube 133, has a traverse rectangular recess 138, and has an arcuate surface 139 on a side thereof opposite from the recess 138. The tube 133 has an arcuate slot 141, a radial pin 142 on the locking element 137 projects outwardly through the slot 141, and an L-shaped spring support 143 on the tube 133 supports one end of a helical expansion spring 144 which acts on the pin 42 to urge the locking element 137 toward its locking position, the locking element 137 being pivotal between locking and release positions which are functionally equivalent to the corresponding positions of locking element 97.

Referring to FIG. 5, a radially extending flange 147 is welded to an end portion of the cylindrical locking element 137 which projects outwardly beyond the tube 133. An L-shaped bracket 148 is secured to the outer member 74, and an operating cable 151 has an outer sleeve 152 secured at one end in a conventional manner to the bracket 148, and has a wire 153 which extends slidably through the outer sleeve 152 and an opening in bracket 148, and extends slidably through an opening in the flange 147 and has a stop 154 fixedly crimped to its outer end.

Referring to FIG. 2, a radial flange 157 is welded to the sleeve 116 and an L-shaped bracket 158 is welded to the tube 93, the cable 151 having an end of sleeve 152 fixedly secured to the bracket 158 so that wire 153 extends slidably through an opening in the bracket and through an opening in flange 157, the wire 153 having a stop 159 fixedly crimped to its outer end.

Figure 8:
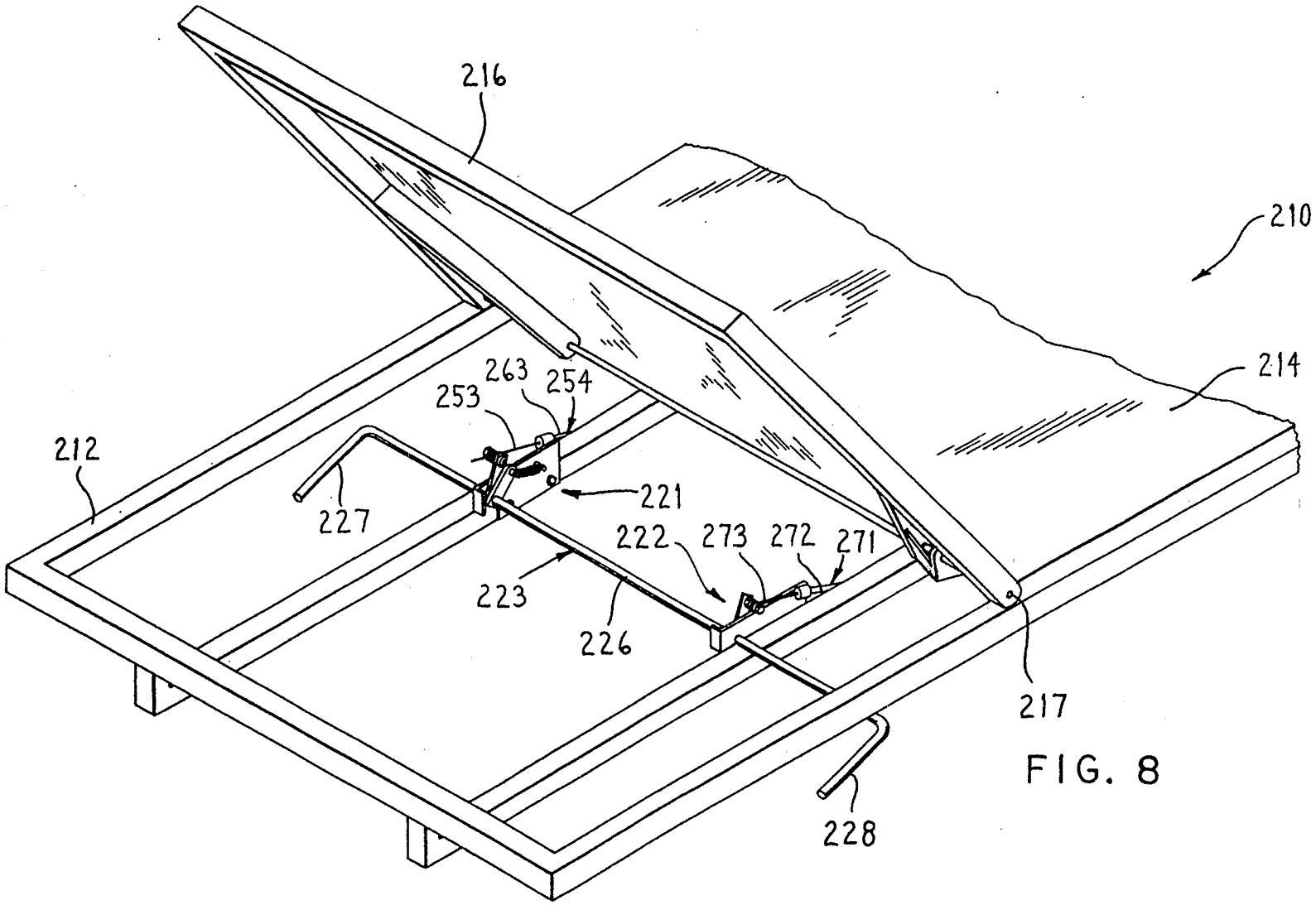
FIG. 8 is a fragmentary perspective view of another stretcher which embodies an alternative form of the present invention.

FIGS. 8–14 depict a bed or stretcher 210 which represents an alternative embodiment of the present invention. Referring to FIG. 8, the stretcher 210 has a frame 212 and a seat section 214 which supports an upper body support section 216 for pivotal movement at 217.

Two cable operating mechanism 221 and 222 are supported at traversely spaced locations on the frame 212, and a U-shaped release member 223 has a traversely extending bight 226 which extends through each of the operating mechanisms 221 and 222, and has legs 227 and 228 at its opposite ends which extend approximately horizontally and serve as manually operable release handles each located adjacent a respective side of the stretcher. It will be noted that the release handles 227 and 228 are disposed below the upper body support section 216 so that they are closer to the patient and thus more convenient for use by medical personnel. The operating mechanisms 221 and 222 are mirror images of each other, and thus only the operating mechanism 221 will be described in detail.

Figure 9:
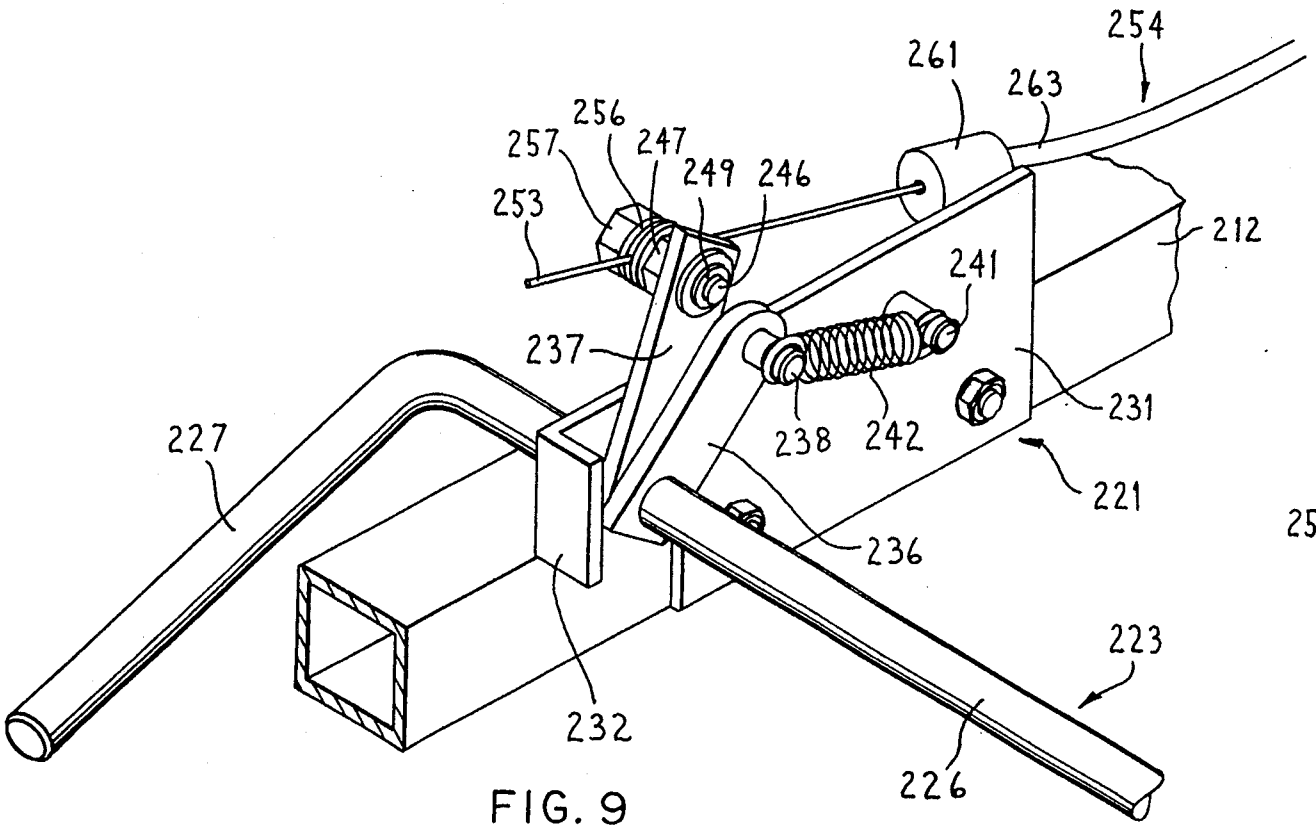
FIG. 9 is a fragmentary perspective view of a cable operating mechanism which is part of the stretcher shown in FIG. 8.
Figure 10:
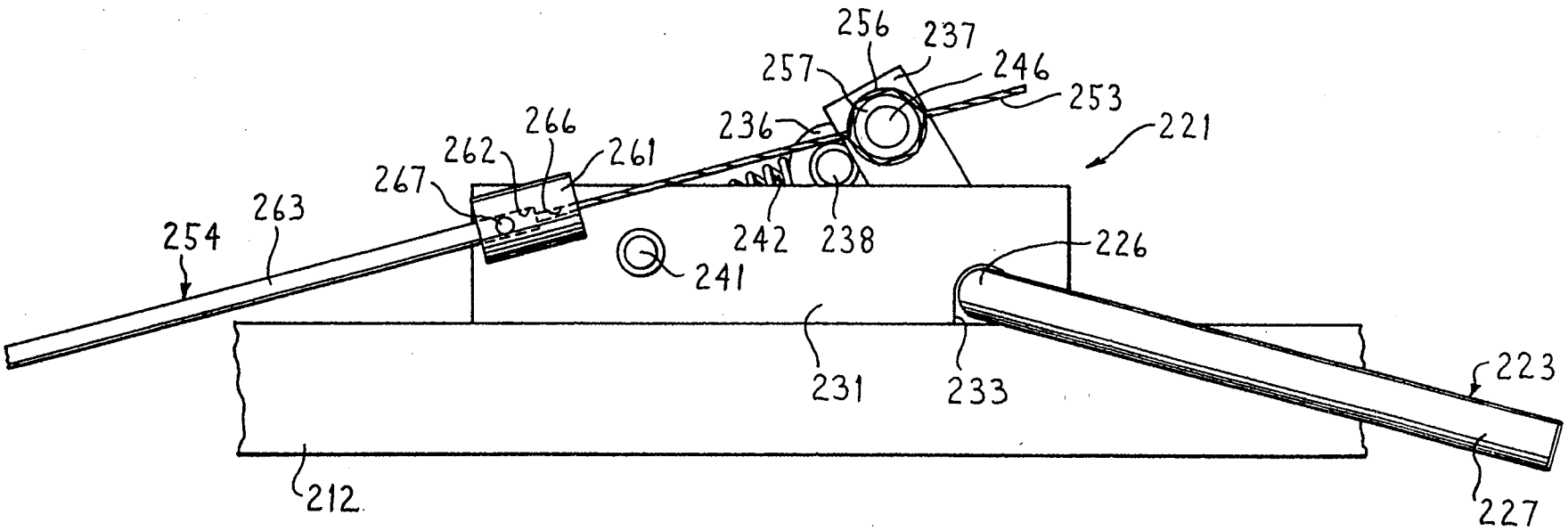
FIG. 10 is an elevational side view of the cable operating mechanism of FIG. 9.

More specifically, referring to FIGS. 9 and 10, the operating mechanism 221 includes a plate 231 which is secured to the frame 212, and which has at one end a tab 232 bent to extend at 90° to the rest of the plate. The plate also has an opening 233 (FIG. 10) through which the bight 226 of release member 223 rotatably extends. A spring return arm 236 is fixedly secured to and projects radially outwardly from the bight 226 of release member 223, and a cable operating arm 237 has its lower end freely pivotally supported on the bight 226 between the arm 236 and the plate 231.

The arm 236 has secured in its upper end a traverse pin 238 which projects outwardly on each side of arm 236, one end of which supports a helical expansion spring 242 having its other end supported on a pin 241 fixedly secured on plate 231. The spring 242 pulls the arm 236 toward the position shown in FIGS. 9 and 10, in which the pin 238 engages the upper edge of plate 231 to limit pivotal movement of arm 236 and release member 223. When the spring return arm 236 is in this position, the range of pivotal movement of the cable operating arm 237 is limited at its opposite ends by engagement of arm 237 with the pin 238 and with the tab 232. When the release member 223 is operated, the arm 236 is pivoted against the urging of spring 242, and engagement of pin 238 with arm 237 causes arm 237 to be pivoted from the position shown in FIGS. 9 and 10 toward the tab 232, until the arm 237 engages the tab 232 and prevents further movement of both arms 236 and 237 as well as the release member 223.

Figure 11:
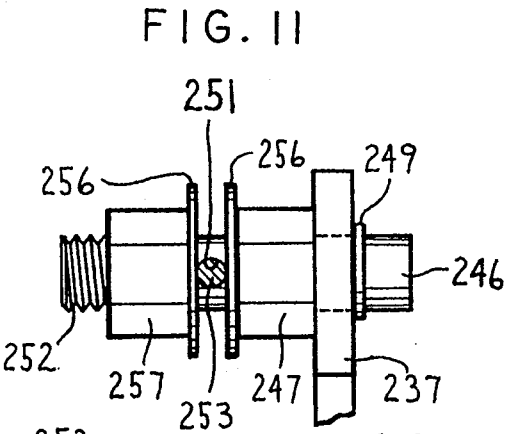
FIG. 11 is a fragmentary elevational end view in an enlarged scale of a portion of the mechanism of FIGS. 9 and 10.
Figure 12:
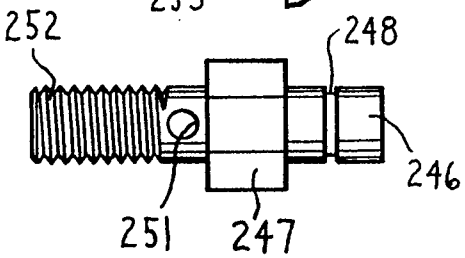
FIG. 12 is a view of a pin which is a component of the mechanism shown in FIG. 11.

The upper end of arm 237 supports a cable pin 246, which as shown in FIGS. 11 and 12 has a hexagonal central portion 247 disposed against one side of arm 237 and has a circumferential groove 248 on the opposite side of arm 237, the groove 248 receiving a snap ring 249 to fixedly secure the cable pin 246 to arm 237. The opposite end of the cable pin 246 is threaded at 252, and between the threads 252 and the hexagonal central portion 247 is a portion with a traverse hole 251. A wire 253 of an operating cable 254 extends through the hole 251, two washers 256 are provided on the pin 246 on opposite sides of the wire 253, and a nut 257 engages the threads 252 to cause the wire 253 to be clamped between the washers 256, which in turn are clamped between nut 257 and hexagonal central portion 247.

As shown in FIG. 10, a cylindrical cable clamp 261 is fixedly secured to the plate 231 at a slight incline with respect to a horizontal reference, and has extending through it a central axial opening with a large diameter portion 262 which receives an end of an outer sleeve 263 of the cable 254, and a small diameter portion 266 through which the wire 253 of the cable slidably extends. A setscrew 267 fixedly releasably secures the sleeve 263 within the cable clamp 261.

As shown in FIG. 8, the other cable operating mechanism 222 controls a further operating cable 271, which has a sleeve 272 and a wire 273.

The bed 210 of FIG. 8 has a not-illustrated pivotal knee support section which is similar to the knee support section 22 shown in FIG. 1, and has a drive mechanism and coupling arrangement to effect movement of the knee support section which are effectively identical to those described above in association with the embodiment of FIG. 1, except as described below.

Figure 13:
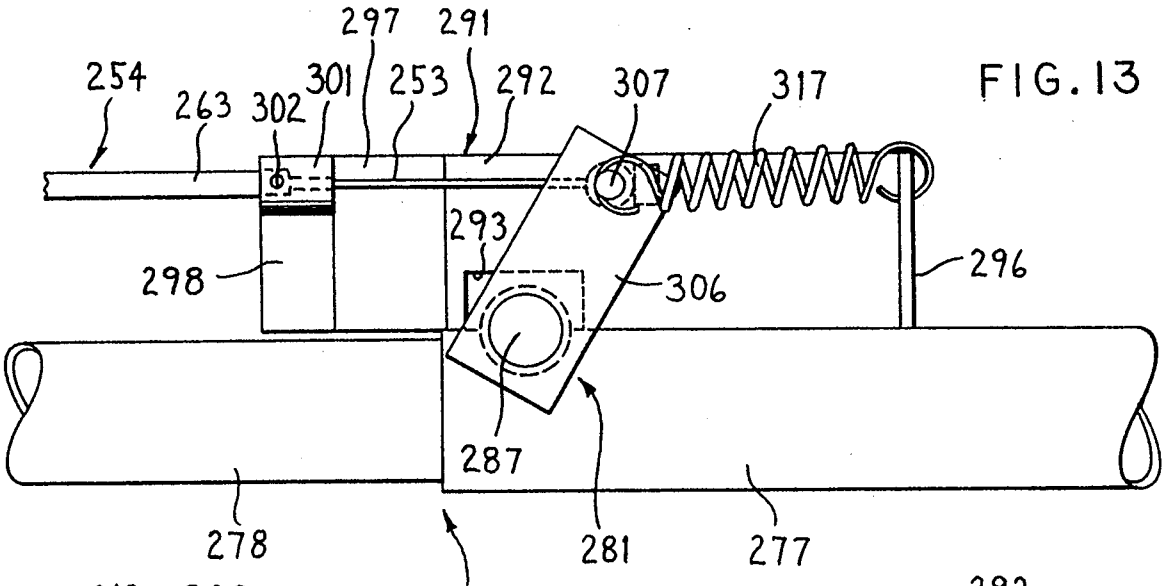
FIG. 13 is a fragmentary elevational side view of a coupling arrangement and releasable locking mechanism which are portions of the stretcher of FIG. 8.
Figure 14:
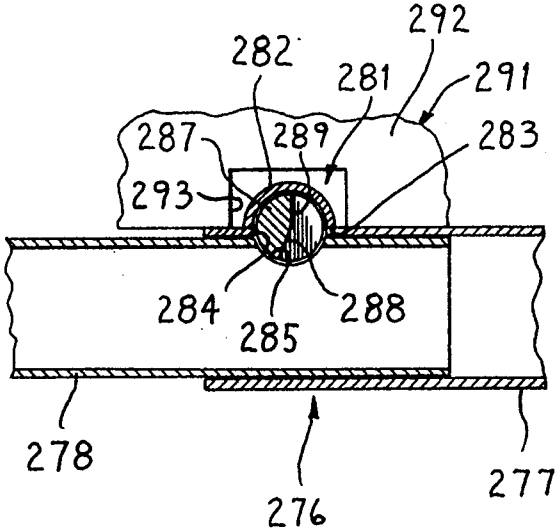
FIG. 14 is a fragmentary sectional side view of the structure shown in FIG. 13.
Figure 15:
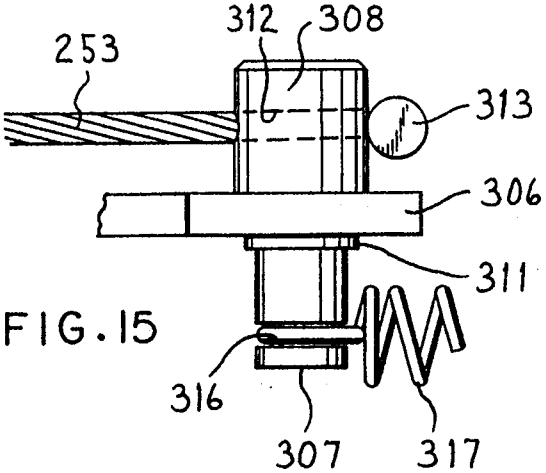
FIG. 15 is a fragmentary top view of a portion of the structure shown in FIG. 13.

More specifically, referring to FIGS. 13–15, a coupling arrangement 276 has a pair of telescoping tubular members 277 and 278 which are similar to the members 74 and 75 of FIG. 2. A releasable locking mechanism 281 includes a tube 282 having a traverse semicylindrical recess 283 which receives the outer member 277, the tube 282 being welded to outer member 277 and having a central opening which is coaxial with semicylindrical recesses 284 and 285 in the outer member 277 and inner member 278. A cylindrical locking element 287 is rotatably disposed within the tube 282, and has a traverse recess of generally rectangular shape, the inner surface of which is defined by two radially extending surface portions 288 and 289 that intersect at the axis of rotation of the locking element 287 so as to form an obtuse angle.

A bent metal plate 291 has a main portion 292 with a rectangular recess 293 in its bottom edge, the tube 282 extending through recess 293 and the bottom edge of main portion 292 being welded to the top of outer member 277. A flange 296 extends forwardly (out of the plane of FIG. 13) from one end of main portion 292 at an angle of 90° thereto, and a portion 297 is inclined forwardly and leftwardly in FIG. 13 from the main portion 292 and merges into an end portion 298 which extends approximately parallel to main portion 292. A cylindrical cable clamp 301 is fixedly welded to the end portion 298, is similar to the cable clamp 261 of FIG. 10, and has a setscrew 302. One end of the outer sleeve 263 of cable 254 is disposed in the clamp 301 and is held there by setscrew 302.

A radially extending arm 306 is welded to the locking element 287. A pin 307 extends through an opening at the upper end of arm 306, has a cylindrical head 308 disposed against one side of arm 306, and is held in place by a snap ring 311 which engages a not-illustrated groove in the pin 307. The cylindrical head 308 of the pin has a traverse hole 312 through which the wire 253 of cable 254 extends, a stop 313 being crimped to the outer end of wire 253. The opposite end of pin 307 has a groove 316 which supports one end of a helical expansion spring 317, the opposite end of the spring being supported on the flange 296.

The upper body support section 216 of FIG. 8 is pivoted by a drive mechanism and coupling arrangement which are similar to those shown at 32 and 41 in FIG. 1, except for the differences described below. More specifically, with reference to FIG. 16, a coupling arrangement 321 includes telescoping outer and inner members 322 and 323 which are equivalent to the members 42 and 43 in FIG. 1. A gas cylinder 326 has its ends supported on blocks 327 and 328 which are respectively secured to the outer and inner members 322 and 323. A releasable locking mechanism 331 is provided to releasably hold the members 322 and 323 against relative movement, and is effectively identical to the locking mechanism 281 described above with reference to FIGS. 13 and 14, except that it is physically inverted.

A radially extending arm 322 is secured to the cylindrical locking element of the locking mechanism 331, and has at its upper end a pin 333 which is identical to the pin 307 shown in FIG. 15. A plate 336 welded to the top of outer member 322 is identical to the plate 291 of FIG. 13, except that it is not as tall and has no rectangular recess in its bottom edge. A cable clamp 337 is secured to an end portion of the plate 336, and has a setscrew fixedly holding one end of the outer sleeve 272 of cable 271. The wire 273 of cable 271 extends through a hole in the head of pin 333, and has a stop 338 crimped to its outer end. A helical expansion spring 339 extends between the pin 333 and a flange 341 on the plate 336.

OPERATION

Referring first to the embodiment of FIGS. 1 to 7, when the releasable locking mechanism 51 (FIG. 3) is engaged, the arcuate surface 99 on locking element 97 engages the arcuate surface of recess 91 and prevents rightward movement of member 43 telescopically into outer member 42. Thus, as the crank 37 (FIG. 1) of drive mechanism 32 is rotated, the members 42 and 43 move rightwardly or leftwardly with a fixed length, which through the link 57 and arm 61 effects upward or downward pivotal movement of the upper body support section 18 about axis 19. Likewise, when the locking mechanism 79 of FIG. 6 is engaged, the arcuate surface 139 on locking member 137 engages the arcuate surface in recess 131 to prevent the inner member 75 from moving rightwardly in FIG. 6 (leftwardly in FIG. 1) relative to the outer member 74. Thus, as the crank 72 (FIG. 1) of the drive mechanism 68 is operated, the members 74 and 75 moved leftwardly or rightwardly in FIG. 1 with a fixed length and, through arm 82, cause the knee support section 22 to pivot upwardly or downwardly.

If the upper body support section 18 and knee support section 22 are in the inclined position shown in FIG. 1, and if one of the release handles 111 or 124 (FIG. 2) is pivoted downwardly, the cylindrical locking element 97 is rotated approximately 90° clockwise against the urging of spring 104 from the position shown in FIG. 3, so that the arcuate surface 99 on locking element 97 moves out of engagement with the arcuate surface of recess 91, and the member 43 can slide rightwardly relative to member 42 within the recess 98 in the locking element 97. Consequently, the coupling arrangement 41 defined by members 42 and 43 decreases relatively rapidly in length, limited only by the speed of the gas cylinder 52, and the upper body support section 18 pivots relatively rapidly from the inclined position of FIG. 1 back to its horizontal position.

Also, when one of the handles 111 or 124 is pressed down, the flange 157 (FIG. 2) on sleeve 116 pivots rightwardly (clockwise) in FIG. 2, and pulls the wire 153 within the sleeve 152 of cable 151. Thus, at the opposite end of cable 151 (FIG. 5), the wire 153 moves leftwardly and the stop 154 at its end pulls the flange 147 leftwardly so that locking element 137 pivots counterclockwise, the arcuate surface 139 (FIG. 6) on the locking element 137 pivots out of engagement with the arcuate surface of recess 131, and the inner member 75 is released to move rightwardly in FIG. 6 (leftwardly in FIG. 1) with respect to outer member 74, the inner member 75 sliding within the recess 138 of locking element 137. The overall length of the coupling arrangement defined by members 74 and 75 thus increases, which permits the knee support section 22 (FIG. 1) to pivot rapidly from its inclined position down to its horizontal position.

To reengage the locking mechanism 51, the crank 37 (FIG. 1) is operated to move the member 42 rightwardly in FIG. 1 relative to member 43 and, when the semicircular recesses 91 and 92 (FIG. 3) again become coaxially aligned, the spring 104 (FIG. 2) pivots the locking element 97 back to the locking position of FIG.

3. Likewise, the hand crank 72 can be operated to move the member 74 leftwardly in FIG. 1 until the locking mechanism 79 automatically reengages itself in a similar manner.

Figure 16:
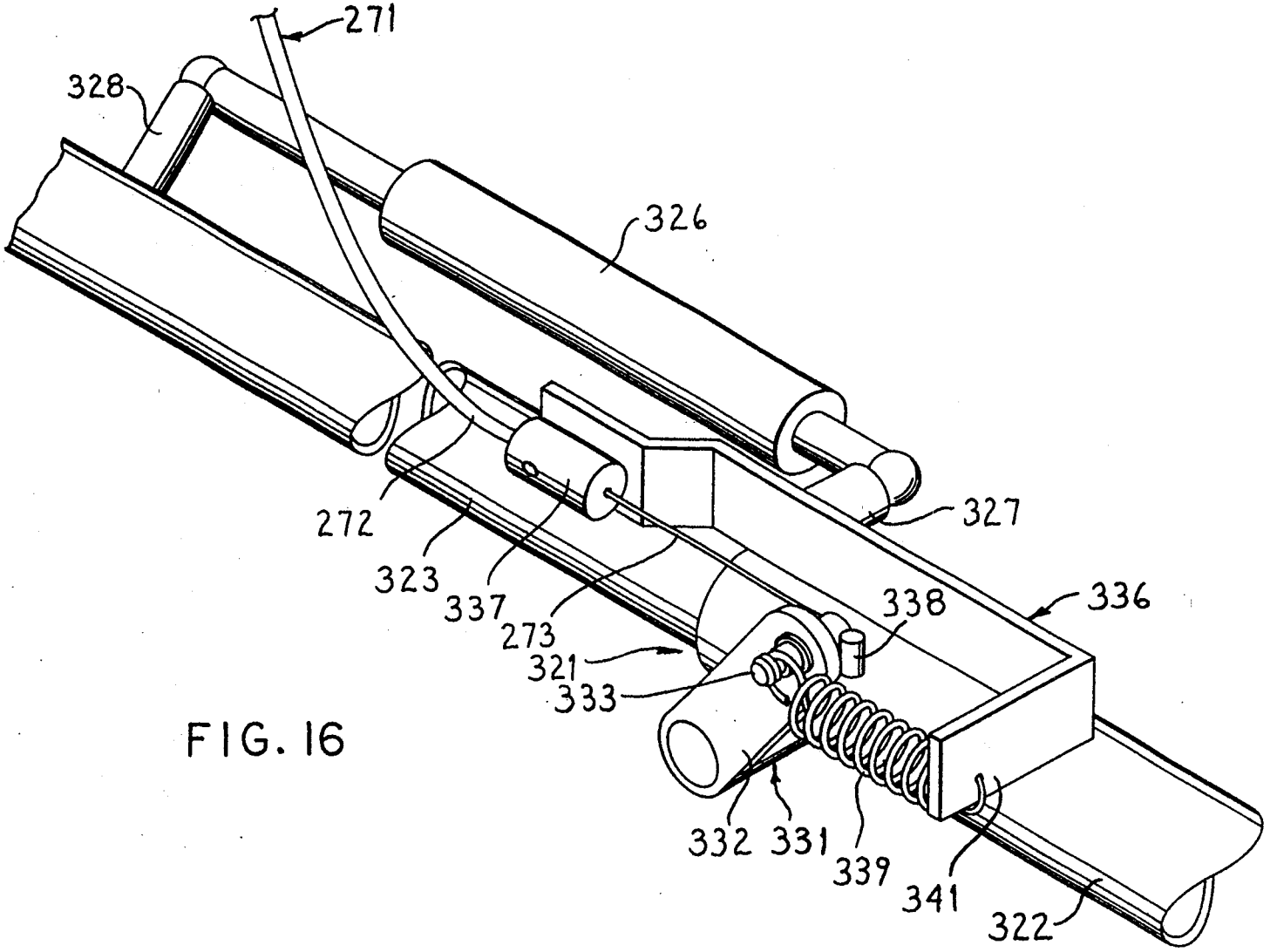
FIG. 16 is a perspective view of a further coupling arrangement and locking mechanism which are portions of the stretcher of FIG. 8.

In the embodiment of FIGS. 8–16, manual operation of either of the release handles 227 or 228 (FIG. 8) effects pivotal movement of the arm 236 (FIG. 9) of each cable operating mechanism 221 and 222, the pin 238 on each arm in turn pivoting the adjacent arm 237 to pull the attached cable wire within the associated cable. Thus, at the opposite end of cable 254, the wire 253 is pulled to pivot arm 306 against the urging of spring 317 in order to pivot locking element 287, which effects a release in a manner similar to that described above for the locking mechanisms of the first embodiment. Simultaneously, with reference to FIG. 16, the movement of wire 273 of cable 271 pivots the arm 332 against the urging of spring 339 to release the locking mechanism 331. Then, both the upper body support section and the knee support section pivot back to their horizontal positions in a manner similar to that described above for the embodiment of FIG. 1. The locking mechanisms 281 and 331 of FIGS. 13 and 16 are reengaged in a manner similar to that described above for the locking mechanisms of the first embodiment.

Although two preferred embodiments of the present invention have been shown and described in detail for illustrative purposes, it will be recognized that there are variations and modifications of the disclosed embodiments, including the reversal and rearrangement of parts, which lie within the scope of the present invention.

The embodiments of the invention in which an exclusive property or privileged is claimed are defined as follows:

1. A bed, comprising: an upper body support section supported for movement between a substantially horizontal position and a raised position; a selectively actuatable drive mechanism; coupling means for releasably drivingly coupling said drive mechanism to said upper body support section to effect movement of said upper body support section in response to operation of said drive mechanism, said coupling means including an elongate tubular first member and an elongate second member which has a portion telescopically slidably supported within said first member for movement between first and second positions relative thereto, wherein as said upper body support section is moved toward said raised position by said drive mechanism and said coupling means, said second member is urged toward said second position with respect to said first member, said coupling means further including a locking portion provided on one of said first and second members and a locking part supported on the other thereof for movement between a locking position in which said locking part physically engages said locking portion when said first and second parts are in said first position and a release position in which said locking part is free of engagement with said locking portion, wherein when said locking part is engaging said locking portion said second member is held against movement away from said first position toward said second position with respect to said first member; and manually operable release means for effecting movement of said locking part to said release position thereof, so that said upper body support section is disengaged from said drive mechanism to permit rapid movement of said upper body support section to said substantially horizontal position.

2. A bed according to claim 1, wherein said one of said first and second members has therein a recess with an arcuate surface which is said locking portion, and wherein said locking part has thereon an arcuate surface with substantially the same radius as said arcuate surface of said locking portion, said arcuate surfaces of said locking portion and said locking part being substantially coaxial when said first and second members are in said first position and being in engagement when said locking part is in said locking position to thereby prevent said first and second members from moving away from said first position thereof toward said second position thereof.

3. An apparatus according to claim 1, wherein said locking part has a recess within which said member having said locking portion slides during movement of said members between said first and second positions when said locking part is in said release position.

4. A bed according to claim 1, wherein said movement of said locking part between said locking and release positions is pivotal movement.

5. A bed according to claim 4, wherein said locking part is cylindrical and supported for rotational movement about a central axis thereof which extends traversely to a direction of relative movement of said first and second members, the member with said locking portion including a first recess having said locking portion therein, and said cylindrical locking part having a traversely extending second recess, wherein in said locking and release positions a portion of said locking part axially aligned with said second recess therein is disposed in and spaced from said first recess having said locking portion.

6. A bed according to claim 5, wherein said tubular first member is substantially cylindrical, and wherein said locking mechanism includes a tube having a traversely extending semicylindrical recess which receives a portion of said tubular first member, said tubular first member having a traversely extending semicylindrical recess substantially coaxial with and substantially equal in radius to a central opening through said tube, said cylindrical locking part being rotatably disposed within said tube, and said recess with said locking portion therein being a semicylindrical recess which is substantially equal in radius to said central opening through said tube and which is substantially coaxial with said central opening through said tube when said first and second members are in said first position.

7. A bed according to claim 6, wherein said tube has therein an arcuate slot which extends circumferentially thereof, wherein said cylindrical locking part has a pin thereon which extends radially outwardly within said slot, and including resilient, means cooperable with said pin for yieldably urging movement of said pin within said slot in a direction corresponding to movement of said locking part toward said locking position.

8. A bed according to claim 7, wherein said manually operable release means includes a cable having an outer sleeve with a wire slidably disposed therein, includes means holding said outer sleeve of said cable against movement with respect to said tube, and includes a radially outwardly extending part secured to said locking part and operatively coupled at a radially outer end thereof to said wire of said cable.

9. A bed according to claim 1, including means cooperable with said first and second members for limiting the speed of relative movement thereof from said first position to said second position.

10. An apparatus according to claim 9, wherein said limiting means includes a gas cylinder having ends respectively coupled to said first and second members.

11. A bed, comprising: an upper body support section supported for movement between a substantially horizontal position and a raised position; a selectively actuatable drive mechanism; coupling means for releasably drivingly coupling said drive mechanism to said upper body support section to effect movement of said upper body support section in response to operation of said drive mechanism, a cable having a first end operationally coupled to said coupling means, said cable having an outer sleeve and a wire slidably movable within said outer sleeve, said coupling means being responsive to movement of said wire in a release direction within said outer sleeve for disengaging said upper body support section from said drive mechanism to permit rapid movement of said upper body support section to said substantially horizontal position; and manually controlled cable operating means for effecting movement of said wire in said release direction within said sleeve of said cable, including a manually operable release-handle supported for pivotal movement about an axis, a cable operating arm supported for movement about said axis independently of said release handle and operationally coupled to said wire of said cable at a location spaced radially from said axis, and a further arm nonrotatably coupled to said release handle for pivotal movement therewith and having a portion which is spaced from said pivot axis and is engageable with said cable operating arm for pivoting said cable operating arm in a direction pulling said wire of said cable in said release direction in response to manual rotation of said release handle.

12. A bed according to claim 11, including means for resiliently urging pivotal movement of said release handle and said further arm in a direction opposite said first rotational direction, and means for limiting pivotal movement of each of said arms.

13. A bed according to claim 12, wherein said cable operating arm has secured to a radially outer end thereof a pin which extends approximately parallel to said pivot axis, said pin having a traverse opening through which said wire of said cable extends, and having a threaded portion carrying a nut which can be tightened to urge said wire traversely within said traverse hole so as to frictionally resist lengthwise movement of said wire within said traverse hole.

14. A bed, comprising: an upper body support section supported for movement between a substantially horizontal position and a raised position; a selectively actuatable drive mechanism; coupling means for releasably drivingly coupling said drive mechanism to said upper body support section to effect movement of said upper body support section in response to operation of said drive mechanism, said coupling means including first and second members supported for relative movement with respect to each other between first and second positions, wherein as said upper body support section is moved toward said raised position by said drive mechanism and said coupling means with said first and second members in said first position said first and second members are urged to move toward said second position with respect to each other, said coupling means further including a locking part supported on said first member for rotation about an axis extending traversely to a direction of movement of said second member relative to said locking part, said locking part including a portion with a radially outwardly facing first arcuate surface of predetermined radius which is concentric with respect to said axis, said second member having a locking recess with a radially inwardly facing second arcuate surface which has substantially said predetermined radius and is substantially concentric to said axis when said first and second members are in said first position, said locking part being rotatable about said axis between a locking position and a release position, wherein when said first and second members are in said first position and said locking part is in said locking position said portion of said locking part is disposed in said recess in said second member so that said first and second arcuate surfaces are adjacent and engagement thereof prevents relative movement of said first and second members away from said first position toward said second position, and wherein when said locking part is in said release position said portion thereof is free of engagement with said recess and said first and second members are free to move relative to each other; and manually operable release means for pivoting said locking part to said release position so that said upper body support section is disengaged from said drive mechanism to permit rapid movement of said upper body support section to said substantially horizontal position.

15. A bed, comprising: an upper body support section supported for movement between a substantially horizontal position and a raised position; a selectively actuatable drive mechanism; coupling means for releasably drivingly coupling said drive mechanism to said upper body support section to effect movement of said upper body support section in response to operation of said drive mechanism, said coupling means including first and second members supported for relative movement with respect to each other between first and second positions, wherein as said upper body support section is moved toward said raised position by said drive mechanism and said coupling means with said first and second members in said first position said first and second members are urged to move toward said second position, said coupling means further including means defining in said first member an opening with a substantially cylindrical inner surface of predetermined radius which is concentric to an axis extending traversely to a direction of movement of said second member with respect to said inner surface, a locking part which is a substantially cylindrical element having a cylindrical outer surface with substantially said predetermined radius, said locking part having a portion rotatably disposed in said opening in said first member for movement between a locking position and a release position, said locking part having a further portion with a recess axially aligned with said second member, said second member having therein a locking recess, wherein when said first and second members are in said first position and said locking part is in said locking position said further portion of said locking part is disposed in said locking recess in said second member and engagement therebetween prevents relative movement of said first and second members away from said first position toward said second position, and wherein when said locking part is in said release position said recess in said locking part is aligned with said second member and a portion of said second member which extends along said second member in the direction of movement thereof is movable within said recess in said locking part as said first and second members move between said first and second positions; and manually operable release means for pivoting said locking part to said release position so that said upper body support section is disengaged from said drive mechanism to permit rapid movement of said upper body support section to said substantially horizontal position.

16. A bed according to claim 15, wherein said locking recess in said second member has an arcuate surface therein which has substantially said predetermined radius and is substantially concentric to said axis when said first and second members are in said first position.

17. A bed, comprising: an upper body support section supported for movement between a substantially horizontal position and a raised position; a selectively actuatable drive mechanism; coupling means for releasably drivingly coupling said drive mechanism to said upper body support section to effect movement of said upper body support section in response to operation of said drive mechanism; an elongate release member extending traversely of said bed and supported for rotation about a transverse axis between a locking position and a release position, said release member having spaced handle portions at respective ends thereof which are each disposed adjacent a respective side of said bed; and means responsive to rotation of said release member to said release position for releasing said coupling means so that said upper body support section is disengaged from said drive mechanism to permit rapid movement of said upper body support section to said substantially horizontal position.

18. A bed, comprising: an upper body support section supported for movement between a substantially horizontal position and a raised position, and a knee support section supported for movement between a substantially horizontal position and a raised position; a selectively actuatable first drive mechanism; first coupling means for releasably drivingly coupling said first drive mechanism to said upper body support section for effecting movement of said upper body support section in response to operation of said first drive mechanism; a selectively actuatable second drive mechanism; second coupling means for releasably drivingly coupling said second drive mechanism to said knee support section for effecting movement of said knee support section in response to operation of said second drive mechanism; a manually operable release member supported for movement between normal and release positions; and means responsive to movement of said release member to said release position for releasing each of said first and second coupling means so that said upper body support section and said knee support section are respectively disengaged from said first drive mechanism and said second drive mechanism to permit rapid movement of said upper body support section and said knee support section to said substantially horizontal positions thereof.

* * * * *